US012134006B2

(12) United States Patent
Alfandre et al.

(10) Patent No.: US 12,134,006 B2
(45) Date of Patent: Nov. 5, 2024

(54) COLLAPSIBLE FREESTANDING EXERCISE STATION

(71) Applicant: MWA & Co. LLC, Sandy, UT (US)

(72) Inventors: Michael Alfandre, Sandy, UT (US); Theodore R. Espiritu, Jr., West Valley City, UT (US); Daniel H. Stuart, Layton, UT (US); Zachary D. Henderson, South Weber, UT (US)

(73) Assignee: MWA & Co. LLC, Sandy, UT (US)

( * ) Notice: Subject to any disclaimer, the term of this patent is extended or adjusted under 35 U.S.C. 154(b) by 263 days.

(21) Appl. No.: 17/804,754

(22) Filed: May 31, 2022

(65) Prior Publication Data

US 2022/0379165 A1 Dec. 1, 2022

Related U.S. Application Data

(60) Provisional application No. 63/195,570, filed on Jun. 1, 2021.

(51) Int. Cl.

| | |
|---|---|
| ***A63B 23/12*** | (2006.01) |
| ***A63B 21/00*** | (2006.01) |
| ***A63B 21/068*** | (2006.01) |

(52) U.S. Cl.

CPC .... *A63B 23/1218* (2013.01); *A63B 21/00047* (2013.01); *A63B 21/068* (2013.01); *A63B 2210/50* (2013.01)

(58) Field of Classification Search

CPC ..... A63B 1/00; A63B 21/00047; A63B 21/068; A63B 23/1218; A63B 2210/50; A63B 2210/52; A63B 9/00

See application file for complete search history.

(56) References Cited

U.S. PATENT DOCUMENTS

| | | | |
|---|---|---|---|
| 1,286,151 | A | 11/1918 | Tothill |
| 1,410,149 | A | 3/1922 | Fred et al. |
| 4,696,470 | A | 9/1987 | Fenner |
| 5,389,055 | A | 2/1995 | Gangloff |
| 5,662,556 | A | 9/1997 | Gangloff |
| 5,954,600 | A | 9/1999 | Gill |
| 6,117,054 | A | 9/2000 | Soltanpour |

(Continued)

FOREIGN PATENT DOCUMENTS

| | | | |
|---|---|---|---|
| CN | 201889031 | U | 7/2011 |
| CN | 201921376 | U | 8/2011 |

(Continued)

OTHER PUBLICATIONS

Amazon.com; Khanh Trinh Toes Don't Touch Ground Foldable Free Standing PullUp Bar Stand Sturdy PowerTower Workout Station For Home Gym Strength Training Adjustable Fitness Equipment Multifunctional Exercise Rack; Date downloaded Aug. 12, 2022; https://www.amazon.com/KT-Adjustable-Portable-Equipment-Standing/dp/B07H25C9XR.

(Continued)

*Primary Examiner* — Megan Anderson
(74) *Attorney, Agent, or Firm* — Keller Preece PLLC

(57) ABSTRACT

An exercise station with a pull-up bar is disclosed. The exercise station is freestanding without engaging external structures, and supports a user in performing an exercise routine, such as pull-ups or dips. The exercise station may be collapsed to a small footprint and a low vertical profile without removal or disassembly of the exercise station's components.

20 Claims, 8 Drawing Sheets

(56) References Cited

U.S. PATENT DOCUMENTS

| | | | | |
|---|---|---|---|---|
| D518,534 | S | 4/2006 | Giordano | |
| 7,364,530 | B2 | 4/2008 | Lopez | |
| 8,292,300 | B2 | 10/2012 | Moore, III | |
| 8,783,473 | B1 | 7/2014 | Schosek | |
| 8,808,147 | B2 | 8/2014 | Gillespie et al. | |
| 9,320,955 | B2 | 4/2016 | Aral Diaz | |
| 9,675,829 | B1 | 6/2017 | Katz | |
| D816,173 | S | 4/2018 | Jackson | |
| 10,207,142 | B2 | 2/2019 | Le Nguyen | |
| D844,078 | S | 3/2019 | Salomone | |
| 10,220,252 | B2 | 3/2019 | Jackson | |
| 10,357,675 | B1 | 7/2019 | Katz | |
| 10,695,601 | B2 | 6/2020 | Souffrain | |
| 10,987,532 | B2 | 4/2021 | Lawton | |
| 11,872,431 | B1 * | 1/2024 | Liu | A63B 23/1218 |
| 11,896,863 | B2 * | 2/2024 | Ivanov | A63B 69/34 |
| 2011/0183823 | A1 | 7/2011 | Priday | |
| 2019/0351273 | A1 | 11/2019 | Shan et al. | |
| 2020/0101342 | A1 | 4/2020 | Lawton | |
| 2020/0298055 | A1 | 9/2020 | Sneathen | |

FOREIGN PATENT DOCUMENTS

| | | | |
|---|---|---|---|
| CN | 107297060 | A | 10/2017 |
| CN | 208302013 | U | 1/2019 |
| FR | 2871390 | A1 | 12/2005 |
| FR | 3004655 | A1 | 10/2014 |
| GB | 2544483 | A | 5/2017 |
| NL | 1017493 | C2 | 9/2002 |

OTHER PUBLICATIONS

International Search Report and Written Opinion as received in PCT/US2022/072657 dated Sep. 28, 2022.

* cited by examiner

COLLAPSIBLE FREESTANDING EXERCISE STATION

RELATED APPLICATIONS

This application claims priority to and the benefit of U.S. Provisional Patent Application No. 63/195,570, filed on Jun. 1, 2021 and titled "COLLAPSIBLE FREESTANDING EXERCISE STATION," which is hereby incorporated herein by reference in its entirety.

TECHNICAL FIELD

The present disclosure relates generally to the field of exercise equipment. More particularly, the disclosure is directed to a pull-up station.

BRIEF DESCRIPTION OF THE DRAWINGS

The embodiments disclosed herein will become more fully apparent from the following description and appended claims, taken in conjunction with the accompanying drawings. These drawings depict only typical embodiments, which will be described with additional specificity and detail through use of the accompanying drawings in which:

DETAILED DESCRIPTION

The components of the embodiments as generally described and illustrated in the figures herein can be arranged and designed in a wide variety of different configurations. Thus, the following more detailed description of various embodiments, as represented in the figures, is not intended to limit the scope of the present disclosure, but is merely representative of various embodiments. While various aspects of the embodiments are presented in drawings, the drawings are not necessarily drawn to scale unless specifically indicated.

The phrase "coupled to" is broad enough to refer to any suitable coupling or other form of interaction between two or more entities, including mechanical interaction. Thus, two components may be coupled to each other even though they are not in direct contact with each other. The phrases "attached to" or "attached directly to" refer to interaction between two or more entities which are in direct contact with each other and/or are separated from each other only by a fastener of any suitable variety (e.g., mounting hardware or an adhesive).

References to approximations are made throughout this specification, such as by use of the term "substantially." For each such reference, it is to be understood that, in some embodiments, the value, feature, or characteristic may be specified without approximation. For example, where qualifiers such as "about" and "substantially" are used, these terms include within their scope the qualified words in the absence of their qualifiers. For example, where the term "substantially perpendicular" is recited with respect to a feature, it is understood that in some embodiments the feature may have a precisely perpendicular configuration.

The term "lateral" refers to a direction spanning across the width of an exercise station, from side to side. The term "longitudinal" refers to a direction spanning forward or backward through the exercise station, as viewed by a user while performing a typical exercise routine on the station, such as pull-ups or dips. The longitudinal direction and the lateral direction are substantially perpendicular to each other, and each is substantially perpendicular to the vertical direction.

Additional terminology used in this disclosure refers to expanded and collapsed configurations of an exercise station. When the exercise station is expanded and ready for use, it is in an "expanded state." When the exercise station's first and second stands are collapsed to a low vertical profile, but the base remains expanded, the exercise station is in a "vertically collapsed state." When the exercise station's first and second stands are collapsed to a low vertical profile, and the base is collapsed to a narrow longitudinal profile, the exercise station is in a "fully collapsed state."

Figure 1:
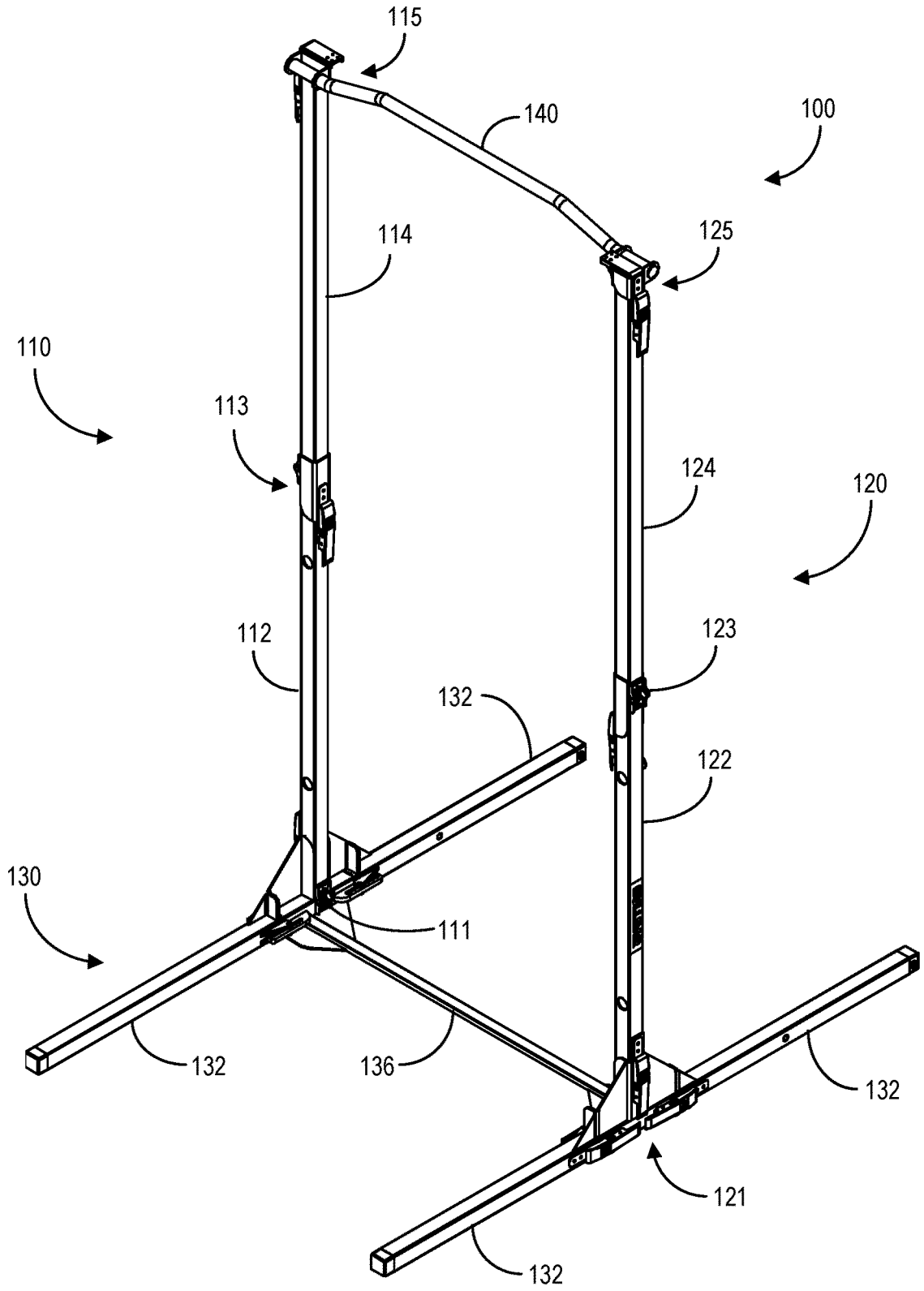
FIG. 1 is a perspective view of an embodiment of a collapsible, freestanding exercise station.

FIG. 1 depicts a perspective view of a collapsible, freestanding exercise station 100 according to one embodiment of the present disclosure. The exercise station 100 has a base 130, a first stand 110, a second stand 120, and a pull-up bar 140. The base 130 is configured to rest on a floor. The first stand 110 is coupled to one side of the base 130, and the second stand 120 is coupled to an opposite side of the base 130. The first stand 110 is coupled to one side of the pull-up bar 140, and the second stand 120 is coupled to an opposite side of the pull-up bar 140. As described further below, the exercise station 100 has expanded and collapsed configurations.

The exercise station 100 is freestanding in that it supports a user performing an exercise routine while the exercise station 100 rests on a floor without engaging any external structure, including a ceiling, a door frame, or a wall. Further, the exercise station 100 does not require mounting or fixture to the floor. In some embodiments, the exercise station 100 may support a user having a weight of up to three hundred pounds. In some embodiments, the exercise station 100 may support a user having a weight of more than three hundred pounds. For example, the exercise station 100 may sustain a pull-up load of up to one thousand pounds.

The exercise station 100 is collapsible in that it may be collapsed to a low vertical profile and a small base footprint for convenient storage and/or transport. Collapse of the exercise station 100 can be done quickly and simply, without lifting the base 130 off of the floor and without detaching or disassembling any of the components of the exercise station 100. The exercise station 100 remains a single assembly throughout collapse, without any components being removed. In some embodiments, the exercise station 100 may require removal of additional handles (described below in connection with FIGS. 7 and 8), but otherwise is collapsible without disassembly of the other components.

As shown in FIG. 1, the exercise station 100 includes a base 130, a first stand 110, a second stand 120, and a pull-up bar 140. In some embodiments, the exercise station 100 may also include additional handles (see FIGS. 7 and 8). The first stand 110 is positioned on one side of the exercise station 100, and is coupled to the base 130 at a lower end of the first stand 110, and to the pull-up bar 140 at an upper end of the first stand 110. The second stand 120 is positioned on the opposite side (in the lateral direction) from the first stand 110, and is similarly coupled to the base 130 at a lower end of the second stand 120 and to the pull-up bar 140 at an upper end of the second stand 120.

The first stand 110 and the second stand 120, while not necessarily mirror images of each other, each comprise similar components with similar functions. The first stand 110 includes a first lower stand member 112 and a first upper stand member 114. The second stand 120 includes a second lower stand member 122 and a second upper stand member 124. The first and second lower stand members 112, 122 and the first and second upper stand members 114, 124 may be elongate elements such as bars, tubes, angles, channels, rods, or the like. The elongate elements may be elongate structural members formed of a steel alloy or other appropriately strong and rigid material. The first and second lower stand members 112, 122 are each hingedly coupled to the base 130 at respective sides of the base 130 by respective first and second lower hinges 111, 121. Next, the first and second lower stand members 112, 122 are each hingedly coupled to their corresponding respective first and second upper stand members 114, 124 by respective first and second middle hinges 113, 123. Further, the first and second upper stand members 114, 124 are each hingedly coupled to the pull-up bar 140 adjacent respective ends of the pull-up bar 140 by respective first and second upper hinges 115, 125.

The first and second middle hinges 113, 123 may be located in respective middle portions of the first and second stands 110, 120. A middle portion of a stand is a portion between two or more stand members of the stand. Thus, a middle portion of the first stand 110 may be found between the first lower stand member 112 and the first upper stand member 114. The middle portion of a stand need not be precisely at a center of the stand. Thus, a lower stand member and an upper stand member need not have identical lengths.

Also depicted in FIG. 1 are the components of the base 130. The base 130 may comprise a base bar 136 which spans the width of the exercise station 100 (in the lateral direction) and rests horizontally on the floor. The base bar 136 may be an elongate element such as a bar, tube, angle, channel, rod, or the like. In some embodiments, the base bar 136 may be a flat elongate plate that rests flat on the floor, as shown in FIG. 1. The lower hinges 111, 121 may be attached to the base bar 136 on either end of the base bar 136 (and thus on either lateral side of the exercise station 100). The base 130 may further comprise one or more feet 132 that rest horizontally on the floor, and that extend in a longitudinal direction (perpendicular to the base bar 136) when expanded. The feet 132 may be elongate elements such as bars, tubes, angles, channels, rods, or the like. In the depicted embodiment, there are four feet 132: a pair of feet on each lateral side of the exercise station 100, with the feet 132 in each pair of feet extending in opposite longitudinal directions when expanded. Each foot 132 may be coupled to the base bar 136 by a hinge. The hinges that couple the feet 132 to the base bar 136 may or may not comprise a locking mechanism. In some other embodiments, there may be only two feet, with one on either lateral side of the exercise station 100, wherein the feet may span longitudinally in both longitudinal directions from the base 130. In some embodiments there may be a single foot member hingedly coupled to the base bar 136 in the center of the base bar 136, and extendable from the base bar 136 in both longitudinal directions when in an expanded state.

Figure 2:
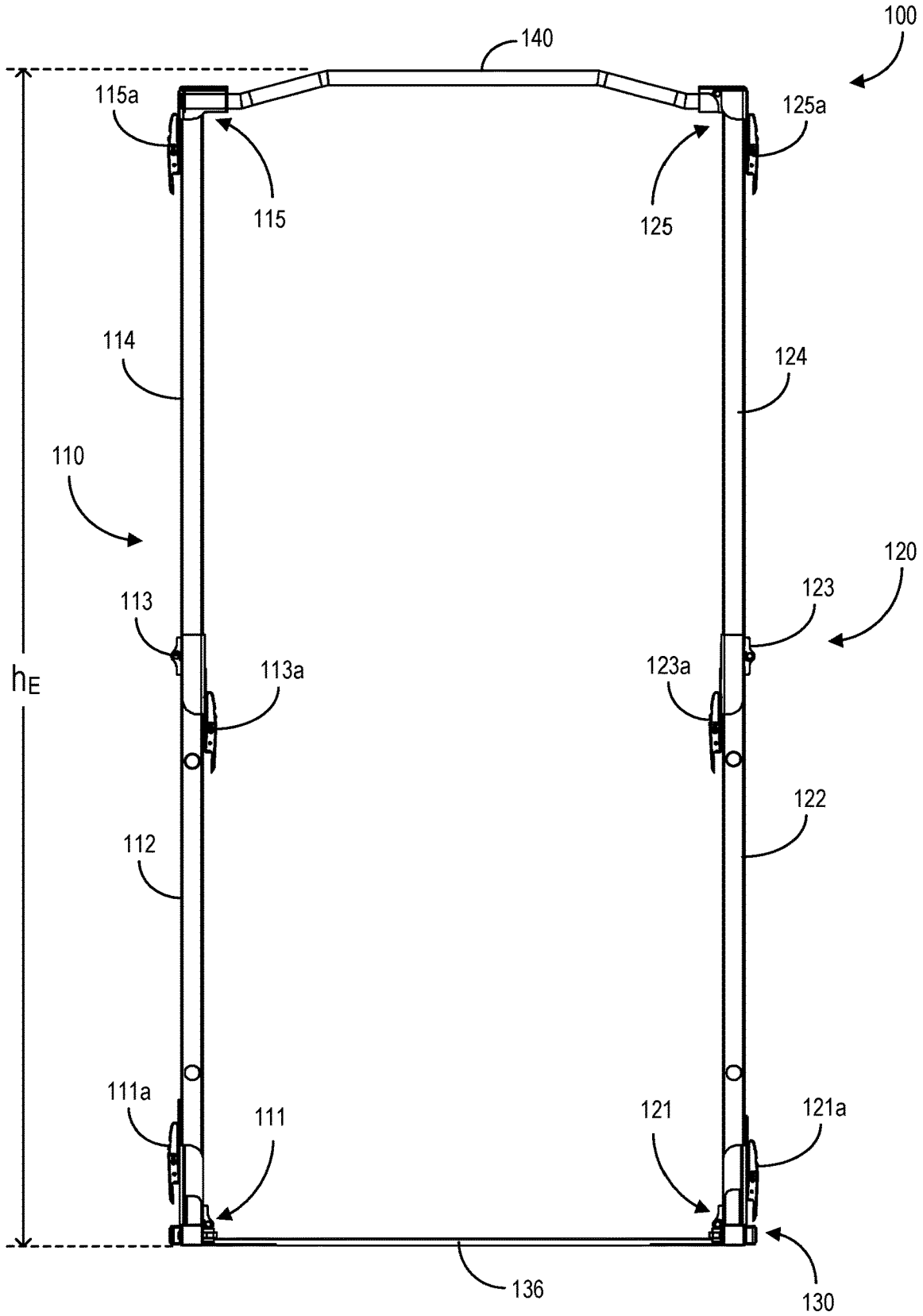
FIG. 2 is a front view of the collapsible, freestanding exercise station of FIG. 1 in an expanded state.

FIG. 2 depicts a front view of the collapsible, freestanding exercise station 100, and provides additional detail, including locking mechanisms for the hinges. The first and second lower hinges 111, 121 each have corresponding first and second lower locking mechanisms 111*a*, 121*a* that, when engaged, secure the first and second lower stand members 112, 122 in substantially vertical orientations. The first and second middle hinges 113, 123 each have corresponding first and second middle locking mechanisms 113*a*, 123*a* that, when engaged, secure the respective first and second upper stand members 114, 124 to be aligned in substantially colinear orientations with their respective first and second lower stand members 112, 122, thus securing the first and second upper stand members 114, 124 in substantially vertical orientations. The first and second upper hinges 115, 125 each have corresponding first and second upper locking mechanisms 115*a*, 125*a* that, when engaged, secure the pull-up bar 140 in a substantially perpendicular orientation with respect to the respective first and second upper stand members 114, 124, such that the pull-up bar 140 is oriented substantially horizontal in the lateral direction. Thus, in the expanded state of the exercise station 100, the pull-up bar 140 has a substantially lateral orientation.

When the several locking mechanisms 111*a*, 113*a*, 115*a*, 121*a*, 123*a*, 125*a* are engaged in a locked state, the exercise station 100 is substantially rigid. The locking mechanisms 111*a*, 113*a*, 115*a*, 121*a*, 123*a*, 125*a* can comprise any of a quick-release pin, a locking quick-release pin, a cotter pin, or a clevis pin on one member, and a receptacle for the pin on the other member (with the terms "member" referring to the respective components that are coupled to each other by the respective hinges). The locking mechanisms 111*a*, 113*a*, 115*a*, 121*a*, 123*a*, 125*a* can comprise any of clamps, latch-style toggle clamps, draw latches, and the like. Alternatively, the locking mechanisms 111*a*, 113*a*, 115*a*, 121*a*, 123*a*, 125*a* can comprise other devices that are engageable to secure the lower and upper stand members 112, 114, 122, 124 in fixed vertical orientations and the pull-up bar 140 in a fixed lateral orientation while the exercise station 100 is in the expanded state.

The locking mechanisms 111*a*, 113*a*, 115*a*, 121*a*, 123*a*, 125*a* each can be easily disengaged into an unlocked state to prepare the exercise station 100 for collapse. Thus, disengagement of the locking mechanisms 111*a*, 113*a*, 115*a*, 121*a*, 123*a*, 125*a* allows the exercise station 100 to fold into a collapsed state. Once the locking mechanisms 111*a*, 113*a*, 115*a*, 121*a*, 123*a*, 125*a* are disengaged, the lower and upper stand members 112, 114, 122, 124 can be rotated inwards (or, in some embodiments, outwards) to fold the exercise station 100 into a vertically collapsed state.

As noted above, FIGS. 1 and 2 depict the exercise station 100 in the expanded state. While in the expanded state, the first and second stands 110, 120 of the exercise station 100 are oriented in a substantially vertical orientation. In some embodiments, the members of the first and second stands 110, 120 may be the only vertically oriented members of the exercise station 100 (while in the expanded state). The pull-up bar 140 is oriented in a substantially horizontal orientation, and more specifically, in a lateral orientation.

Aside from tolerancing and other mechanical phenomena that might prevent the pull-up bar 140 from having a precisely horizontal orientation, the pull-up bar 140 may be an elongate element that is not linear across its length. For example, as shown in FIG. 2, the pull-up bar 140 may have bends along its length to facilitate different gripping portions. Nevertheless, the pull-up bar 140 is, on the whole, oriented substantially horizontally and substantially laterally when the exercise station 100 is in the expanded state. In some embodiments, the exercise station 100 may have an expanded-state height $h_E$ between six feet and eight feet, including approximately seven feet.

In some embodiments, the first and second stands 110, 120 may be coupled to the base 130 through only the lower hinges 111, 121 and their corresponding lower locking mechanisms 111*a*, 121*a*, without an additional brace, structural bracket, or other diagonal support member coupling the lower stand members 112, 122 to the base 130. The attachment of the lower hinges 111, 121 to the base 130 may include a brace, structural bracket, or diagonal support member, but that alone may provide enough stability to the exercise station 100 without the need for additional structural elements coupling the lower stand members 112, 122 to the base 130.

In some embodiments, the pull-up bar 140 and the base bar 136 may be the only members that span the lateral width of the exercise station 100 (when in the expanded state). The exercise station 100 may be rigid and stable enough without the need for additional crosswise members.

Figure 3:
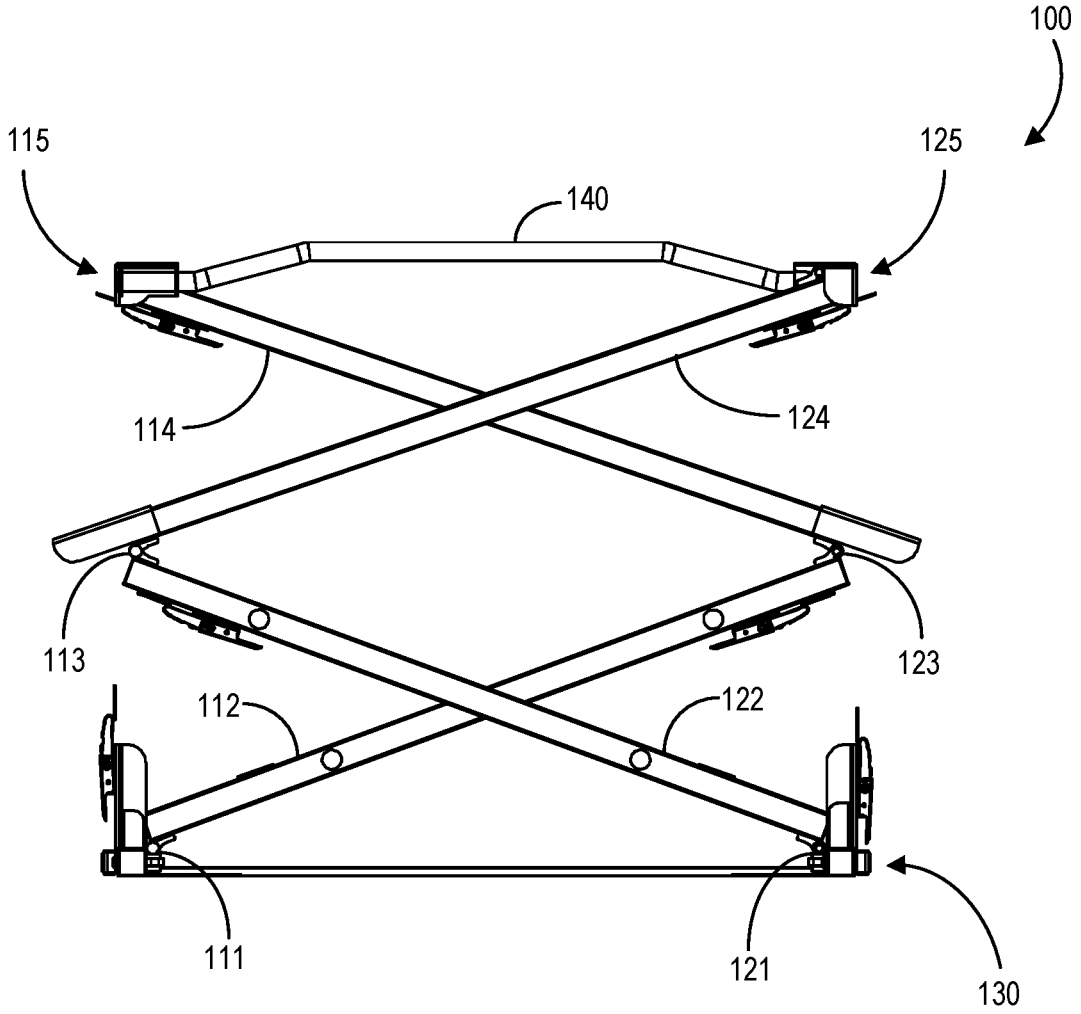
FIG. 3 is a front view of the collapsible, freestanding exercise station of FIG. 1 in a state during either collapsing or expansion of the exercise station.

FIG. 3 depicts a front view of the exercise station 100 during collapse (or, alternatively, during expansion) of the first and second stands 110, 120. In other words, FIG. 3 shows a transition from the expanded state to the collapsed state (or vice versa). Following disengagement of the several locking mechanisms 111*a*, 113*a*, 115*a*, 121*a*, 123*a*, 125*a*, a user may fold the exercise station 100 into the vertically collapsed state by rotating the upper stand members 114, 124 and the lower stand members 112, 122 inwards. The user may exert lateral inward forces on each of the upper stand members 114, 124. These inward forces may cause the middle hinges 113, 123 to move towards each other. To avoid collision or interference between the first and second stands 110, 120 during collapse, the exercise station 100 may be constructed with the first stand 110 offset somewhat in a longitudinal direction from the base bar 136, while the second stand 120 is offset somewhat from the base bar 136 in the opposite longitudinal direction. This longitudinal offset provides room for both the first and second stands 110, 120 to fold into the vertically collapsed state. Additionally, this offset may simplify the construction of the pull-up bar 140 with the upper hinges 115, 125 by providing a coupling spot adjacent each lateral end of, and on opposite longitudinal sides of, the pull-up bar 140 for the respective upper stand members 114, 124. As shown in FIG. 3, the first and second stands 110, 120 are longitudinally offset from each other (in the depicted view, for example, the upper stand member 124 appears in front of the upper stand member 114), allowing them to collapse without interference. Also as shown in FIG. 3, the pull-up bar 140 remains coupled to the upper stand members 114, 124 of the exercise station 100 during collapse.

The exercise station 100 may be collapsed without swinging or moving any components outside of a space substantially defined by the expanded state of the exercise station 100. In other words, in order to collapse the exercise station 100, the exercise station 100 may not need any more room (volume) than that which it already takes up when expanded. In some embodiments, the exercise station 100 may be collapsed without increasing its vertical or longitudinal profiles during collapse. In some embodiments, the exercise station 100 may be collapsed without increasing its vertical, lateral, or longitudinal profiles during collapse. Furthermore, the upper stand members 114, 124 and the lower stand members 112, 122, which substantially define a vertical-lateral plane when in the expanded state, remain substantially in that vertical-lateral plane throughout collapse.

Figure 4:
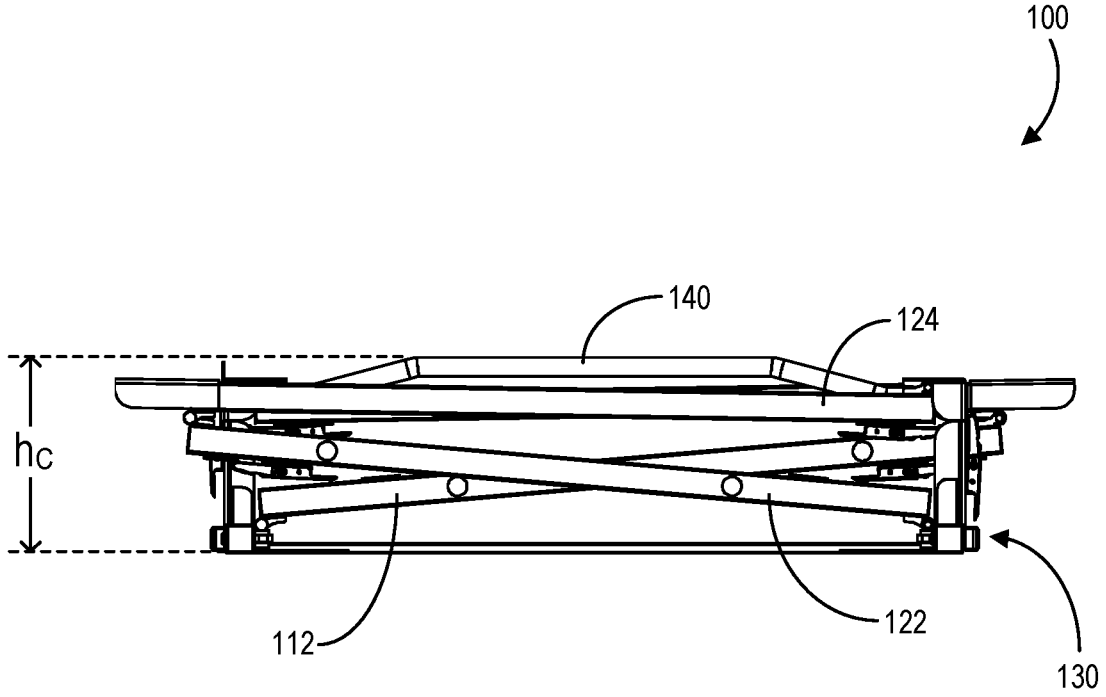
FIG. 4 is a front view of the collapsible, freestanding exercise station of FIG. 1 in a vertically collapsed state.

FIG. 4 depicts a front view of the exercise station 100 with the first and second stands 110, 120 fully collapsed into the vertically collapsed state. The vertically collapsed state has a low vertical profile relative to the expanded state. Upon collapse into the vertically collapsed state, the exercise station 100 may rest in the vertically collapsed state, without further action by the user. Alternatively, the user may proceed to collapse the base 130 such that the exercise station 100 takes the form of the fully collapsed state. In some embodiments, the locking mechanisms on the lower and upper stand members 112, 114, 122, 124 may be engageable when in the vertically collapsed state, in which case the user may lock the exercise station 100 in the vertically collapsed state. FIGS. 2 and 4 show that the pull-up bar 140 has a substantially lateral orientation both in the expanded state of the exercise station 100 and in the vertically collapsed state of the exercise station 100.

When the exercise station 100 is in the vertically collapsed state, the first stand 110 and the second stand 120 each are oriented in a substantially lateral orientation. That is, the lower and upper stand members 112, 114, 122, 124 each have a substantially lateral orientation when folded into the vertically collapsed state.

When collapsed, the exercise station 100 may have a height $h_C$ (a vertical profile) that is less than 20% of a height $h_E$ of the exercise station 100 in the expanded state. For example, some embodiments of the exercise station 100 may have a ratio of vertically-collapsed-state height $h_C$ to expanded-state height $h_E$ between 10% and 15%, including about 13%. Speaking in terms of absolute length, rather than relative ratios, the vertically-collapsed-state height $h_C$ of some embodiments of the exercise station 100 may be between eight inches and fourteen inches, including approximately ten inches or approximately twelve inches.

Figure 5:
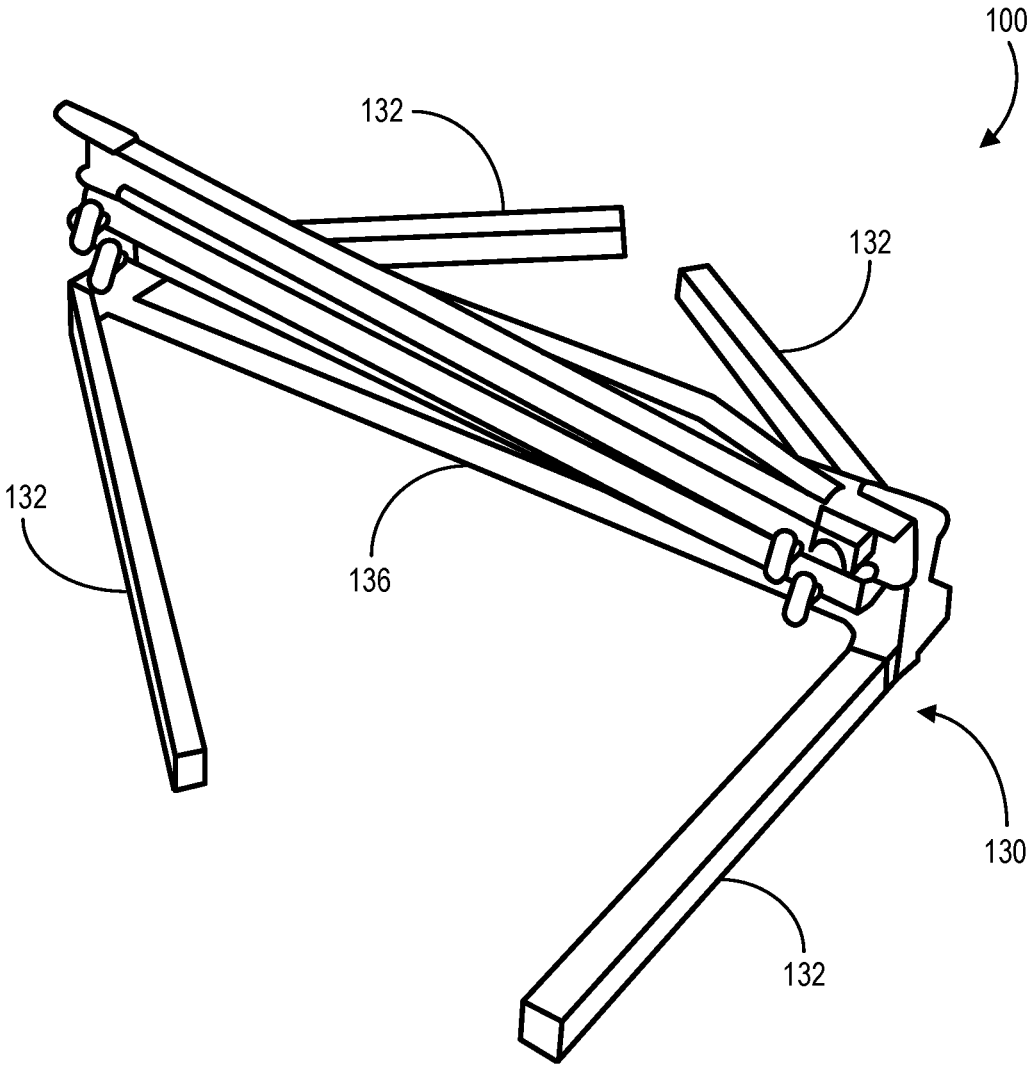
FIG. 5 is a perspective view of the collapsible, freestanding exercise station of FIG. 1 in a vertically collapsed state, with feet of a base of the exercise station in a state during either collapsing or expansion of the feet.

FIG. 5 depicts a perspective view of the exercise station 100, in which the first and second stands 110, 120 are collapsed into the vertically collapsed state, and in which the base 130 is being collapsed (or, alternatively, being extended). As explained above, in some embodiments the hinges by which the feet 132 are coupled to the base bar 136 do not have locking mechanisms. For these embodiments, the feet 132 may be rotated inwards (or, in some embodiments, outwards) in the horizontal plane until they are aligned substantially parallel with the base bar 136. In embodiments with locking mechanisms on the hinges coupling the feet 132 to the base bar 136, a user will first disengage the locking mechanisms before rotating the feet 132 into the collapsed state.

A user may exert inward forces on opposite feet 132 on one longitudinal side of the exercise station 100. These inward forces may cause the feet 132 to move towards each other, as shown in FIG. 5. To avoid interference between the feet 132 during collapse, the user may complete folding one foot inward before folding the other foot. In some embodiments, the feet 132 (or one foot 132 of a pair of feet) may be short enough that no such interference would happen.

Figure 6:
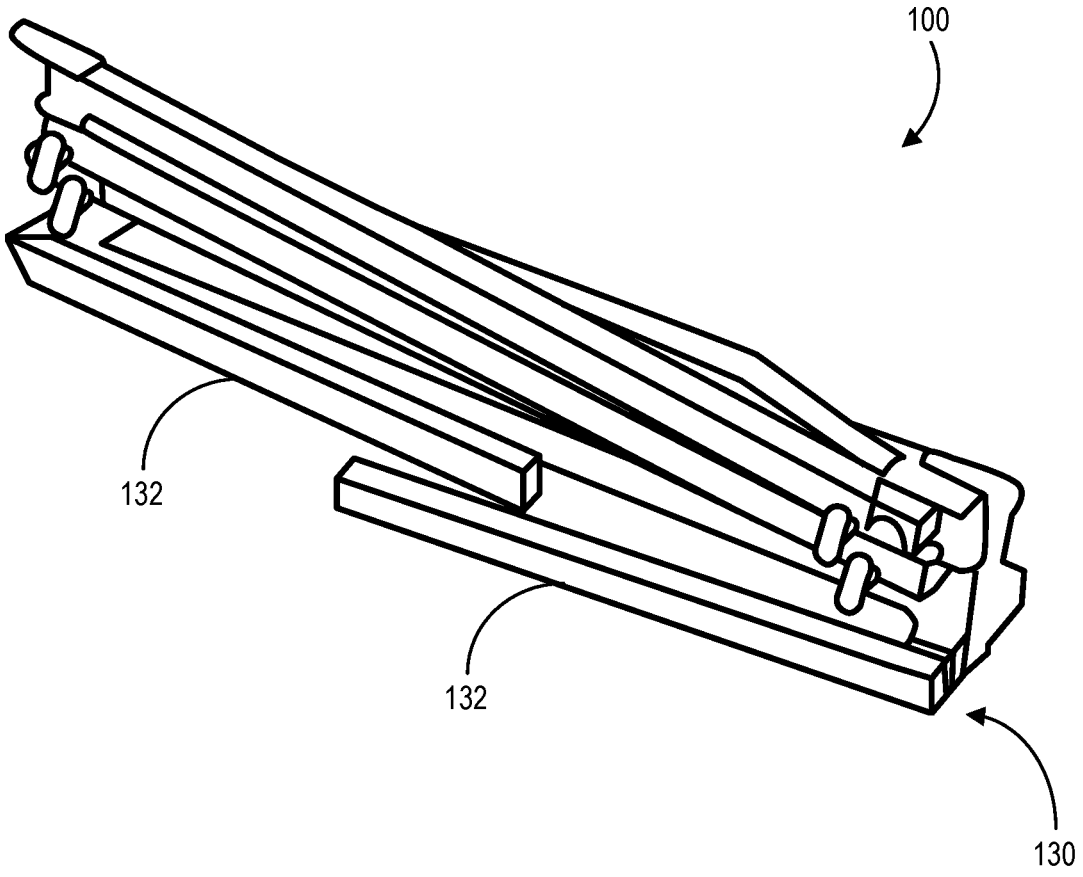
FIG. 6 is a perspective view of the collapsible, freestanding exercise station of FIG. 1 in a fully collapsed state.

FIG. 6 shows a perspective view of the exercise station 100, with the base 130 fully collapsed. Thus, in this view, the exercise station 100 is in the fully collapsed state. The fully collapsed state of the exercise station 100 has both a low vertical profile and a small base footprint with a narrow longitudinal profile. The fully collapsed exercise station 100 may have a longitudinal profile with a length dimension that is about the same as the height $h_C$ of the vertical profile of the fully collapsed exercise station 100. For example, the longitudinal width of the fully collapsed exercise station 100 may be between six and eighteen inches, including approximately twelve inches or approximately fifteen inches.

During collapse, the exercise station 100 may remain a single assembly, without any components being removed. The locking mechanisms 111*a*, 113, 115*a*, 121*a*, 123*a*, 125*a* remain coupled to their corresponding hinges 111, 113, 115, 121, 123, 125 while they are disengaged into an unlocked state, and the exercise station 100 may be easily collapsed without disassembly. In embodiments with additional handles (see description of FIGS. 7-8 below), the additional handles may need to be decoupled from the remainder of the exercise station 100 before collapse, but the exercise station 100 otherwise remains assembled during collapse.

To expand the exercise station 100 from a collapsed state, a user may reverse the collapsing process. That is, the user may pull up on the pull-up bar 140 and orient the upper stand members 114, 124 and the lower stand members 112, 122 into their vertical orientations, and then engage the locking mechanisms 111*a*, 113*a*, 115*a*, 121*a*, 123*a*, 125*a* to secure the exercise station 100 in the expanded state.

Figure 7:
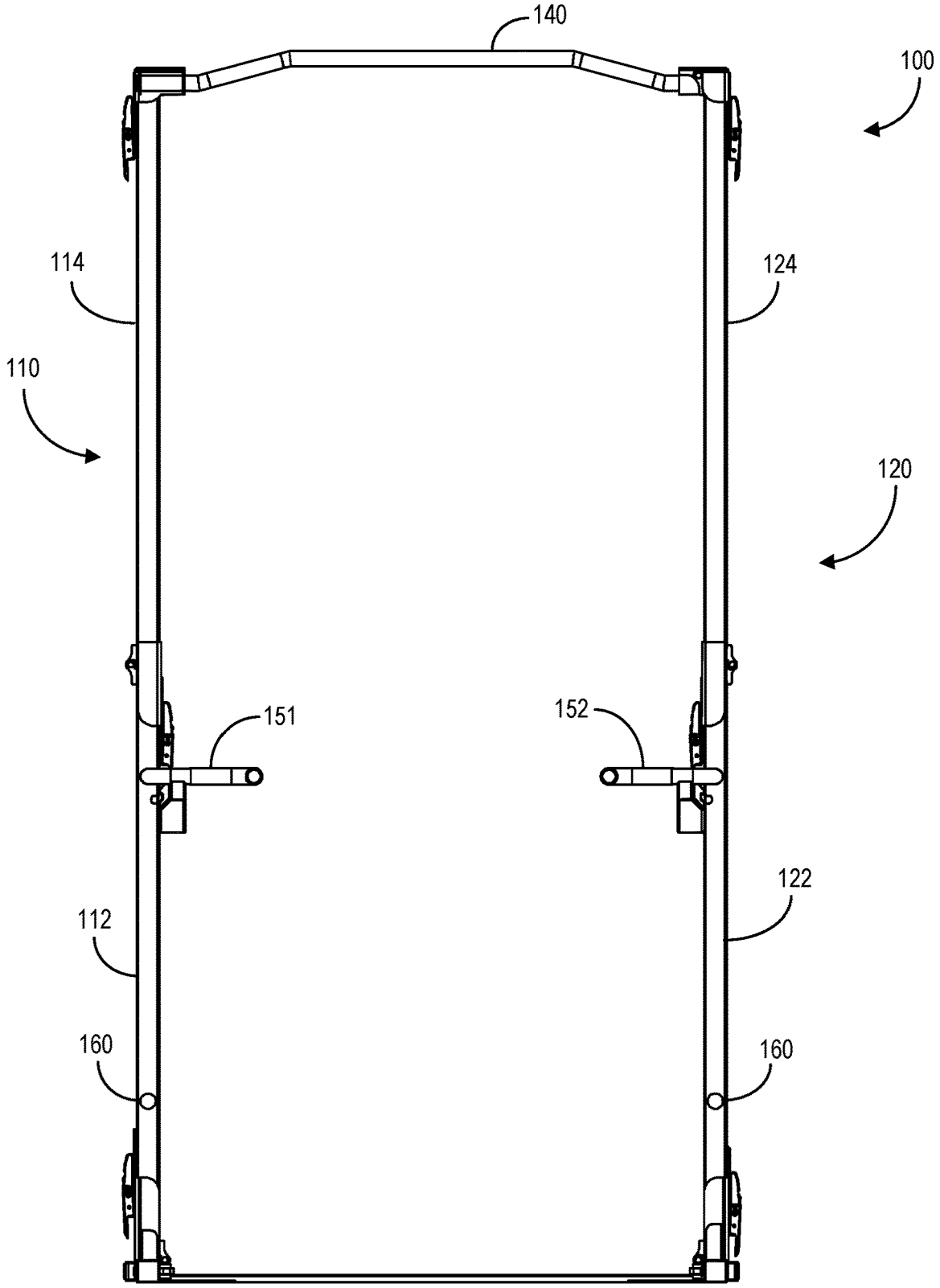
FIG. 7 is a front view of the collapsible, freestanding exercise station of FIG. 1 in an expanded state, with additional handles coupled to stands of the exercise station at a dip bar height.

FIG. 7 depicts a front view of an embodiment of the collapsible, freestanding exercise station 100 with additional handles 151, 152 coupled respectively to the first and second stands 110, 120 of the exercise station 100. The additional handles 151, 152 may support a user performing an exercise routine such as dips or inverted rows. Some embodiments of the exercise station 100, including the embodiment with additional handles 151, 152 depicted in FIG. 7, are laterally wide, with a relatively long pull-up bar 140. The lateral width of a wide embodiment (that is, the length of a long pull-up bar 140) may be between two and a half feet and four and a half feet, including about three feet or about four and a quarter feet. These embodiments may have additional handles 151, 152 that have gripping portions that are offset inwards laterally from their respective stand members. In some embodiments, including the one depicted in FIG. 7, the additional handles 151, 152 are coupled to their respective lower stand members 112, 122. In other embodiments, the additional handles 151, 152 may be coupled to their respective upper stand members 114, 124. The additional handles 151, 152 may be removable from the stand members. Thus, the additional handles 151, 152 may be coupleable to the first and second stands 110, 120, respectively, whereby a user may select whether to use the exercise station 100 with or without the additional handles 151, 152. The additional handles 151, 152 may be foldable on the stand members for easier collapse of the exercise station 100.

Some embodiments of the exercise station 100 are laterally narrow, with a relatively short pull-up bar 140. The lateral width of a narrow embodiment (that is, the length of a short pull-up bar 140) may be between two feet and three and a half feet, including about two and a half feet. These embodiments may have additional handles 151, 152 that are coupled to the first and second stands 110, 120 without any lateral inward offset.

In the view depicted in FIG. 7, the additional handles 151, 152 are coupled to their respective lower stand members 112, 122 at dip bar locations, which are located at a convenient height along the lower stand members 112, 122 for a user to perform dips. The additional handles 151, 152 may have gripping portions with lateral inward offsets from their respective lower stand members 112, 122. The additional handles 151, 152 may be selectively removable from the dip bar locations on the stand members and selectively reinsertable at different locations on the stand members, such as at insertion points 160 along the stands 110, 120. The insertion points 160 may be circular holes, slots, grooves, threaded openings, or the like formed in the stands 110, 120. In some embodiments, the additional handles 151, 152 may need to be removed to collapse the exercise station 100.

Figure 8:
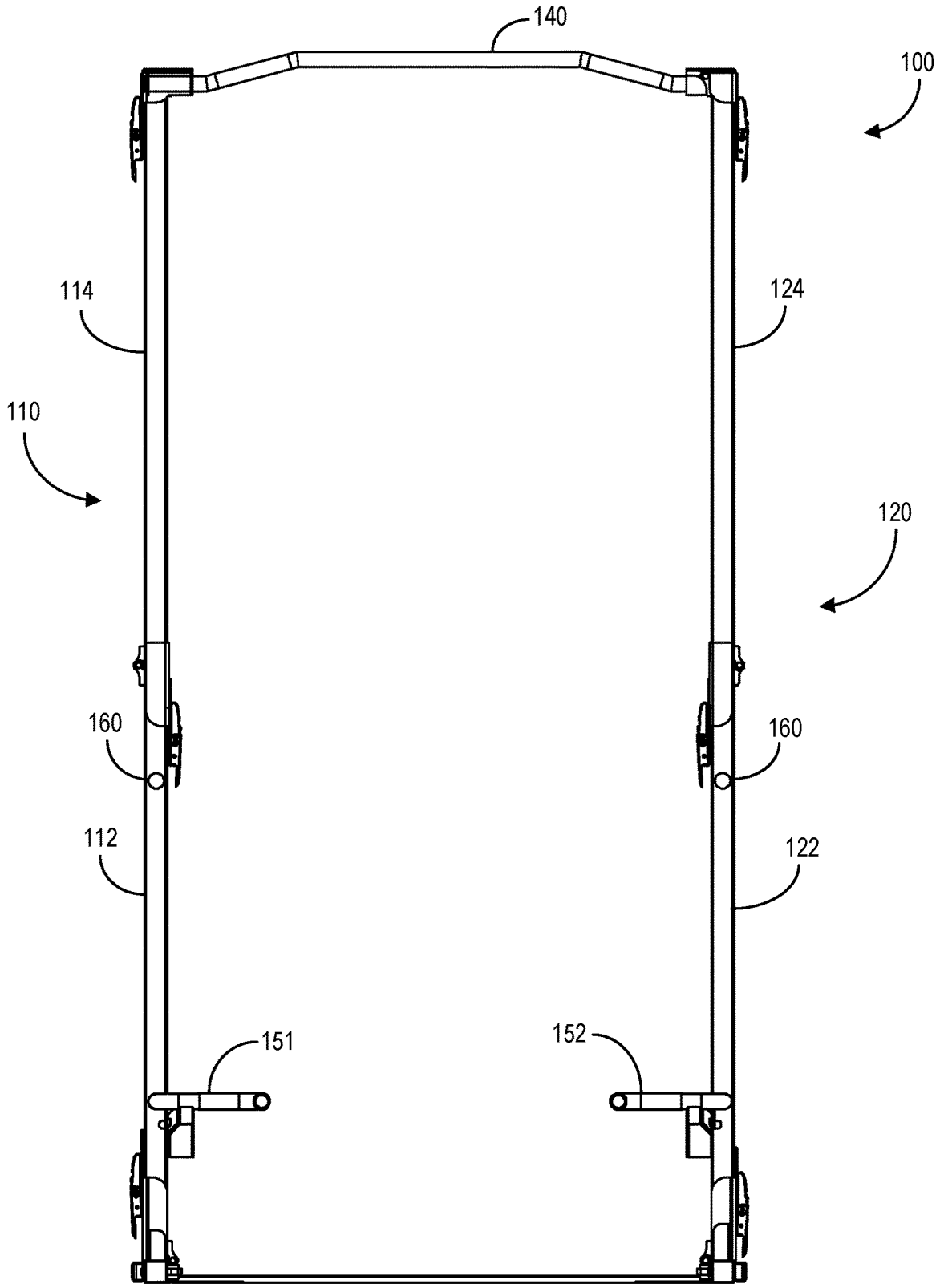
FIG. 8 is a front view of the collapsible, freestanding exercise station of FIG. 1 in an expanded state, with additional handles coupled to stands of the exercise station at a push-up bar height.

FIG. 8 depicts a front view of an embodiment of the collapsible, freestanding exercise station 100 with additional handles 151, 152. The additional handles 151, 152 shown in FIG. 8 can be the same additional handles 151, 152 as shown in FIG. 7, moved to lower locations on the lower stand members 112, 122. The additional handles 151, 152 may support a user while performing an exercise routine such as push-ups. In the view depicted in FIG. 8, the additional handles 151, 152 are coupled to their respective lower stand members 112, 122 at a convenient height for a user to grasp the additional handles 151, 152 and perform push-ups. The additional handles 151, 152 may have a lateral inward offset from their respective lower stand members 112, 122. The additional handles 151, 152 may be selectively removable from the push-up locations on the stand members and selectively reinsertable at different locations on the stand members, such as at insertion points 160 along the stands 110, 120. For example, the additional handles 151, 152 shown in FIG. 8 may be removed from the respective lower stand members 112, 122 and reinserted at higher locations on the stand members—such as at the locations shown in FIG. 7—for use performing dips or inverted rows. The insertion points 160 may be circular holes, slots, grooves, threaded openings, or the like formed in the stands 110, 120. In some embodiments, the additional handles 151, 152 may need to be removed to collapse the exercise station 100.

In some embodiments, there may be several locations along the lower stand members 112, 122 and/or the upper stand members 114, 124 with insertion points 160 in which the additional handles 151, 152 or other equipment are insertable. For example, there may be insertion points 160 in which to selectively insert additional handles 151, 152, or to selectively insert additional support members into the lower or upper stand members 112, 114, 122, 124 for supporting and holding a barbell. The insertion points 160 may be at convenient locations for using the barbell in various exercises, such as a bench press routine, a squat routine, a curl routine, or some other weightlifting exercise. The lower and upper stand members 112, 114, 122, 124 may have numerous such insertion points 160 throughout their lengths for selective insertion of additional support members, such that users of different height may configure the exercise station 100 to suit their personal needs. The insertion points 160 may be circular holes, slots, grooves, threaded openings, or the like formed in the stands 110, 120.

The exercise station 100 in its fully collapsed state may be lifted up off of a floor by a user to engage in other exercise routines, such as curls. For example, a user may curl the fully collapsed exercise station 100 in a manner similar to curling a barbell.

EXAMPLES

The following are some example embodiments within the scope of the disclosure. In order to avoid complexity in providing the disclosure, not all of the examples listed below are separately and explicitly disclosed as combinable with all of the others of the examples listed below and other embodiments disclosed hereinabove. Unless one of ordinary skill in the art would understand that these examples listed below, and the above disclosed embodiments, are not combinable, it is contemplated within the scope of the disclosure that such examples and embodiments are combinable.

Example 1. An exercise station comprising: a base; a first stand; a second stand; and a pull-up bar, wherein, in an expanded state of the exercise station, the base is configured to rest on a floor, the first stand is coupled to the base in a substantially vertical orientation, the second stand is coupled to the base in a substantially vertical orientation, and the pull-up bar is coupled to the first stand and to the second stand in a substantially lateral orientation, and wherein, in a collapsed state of the exercise station, the base is configured to rest on a floor, the first stand is coupled to the base in a substantially lateral orientation, the second stand is coupled to the base in a substantially lateral orientation, and the pull-up bar is coupled to the first stand and to the second stand in a substantially lateral orientation.

Example 2. The exercise station of Example 1, wherein, in the collapsed state of the exercise station, the first stand is folded and the second stand is folded.

Example 3. The exercise station of any one of Examples 1-2, wherein, in the expanded state of the exercise station, the first stand and the second stand define a vertical-lateral plane, and wherein the first stand and the second stand each remain substantially in the vertical-lateral plane during a transition from the expanded state of the exercise station to the collapsed state of the exercise station.

Example 4. The exercise station of any one of Examples 1-3, wherein the first stand remains coupled to the base and to the pull-up bar during a transition from the expanded state of the exercise station to the collapsed state of the exercise station.

Example 5. The exercise station of Example 4, wherein the second stand remains coupled to the base and to the pull-up bar during the transition from the expanded state of the exercise station to the collapsed state of the exercise station.

Example 6. The exercise station of any one of Examples 1-5, wherein the collapsed state of the exercise station has a vertical profile with a height of less than 20% of a height of a vertical profile of the expanded state of the exercise station.

Example 7. The exercise station of any one of Examples 1-6, wherein the first stand is coupled to the base through a first lower hinge and first lower locking mechanism, and wherein the second stand is coupled to the base through a second lower hinge and second lower locking mechanism.

Example 8. The exercise station of any one of Examples 1-7, further comprising a first additional handle and a second additional handle, wherein the first additional handle is coupleable to the first stand, and wherein the second additional handle is coupleable to the second stand.

Example 9. The exercise station of Example 8, wherein the first and second additional handles are offset laterally inwards respectively from the first and second stands.

Example 10. The exercise station of any one of Examples 8-9, wherein the first and second additional handles are selectively removeable from and selectively insertable into the first and second stands.

Example 11. The exercise station of Example 10, further comprising a first plurality of insertion points along the first stand and a second plurality of insertion points along the second stand, wherein the first additional handle is selectively insertable into one or more insertion points of the first plurality of insertion points, and wherein the second additional handle is selectively insertable into one or more insertion points of the second plurality of insertion points.

Example 12. The exercise station of any one of Examples 1-11, wherein the first stand comprises a first middle hinge located in a middle portion of the first stand and the second stand comprises a second middle hinge located in a middle portion of the second stand.

Example 13. The exercise station of any one of Examples 1-12, wherein the first stand is coupled to the base through a first lower hinge, and wherein the second stand is coupled to the base through a second lower hinge.

Example 14. The exercise station of any one of Examples 1-13, wherein the first stand is coupled to the pull-up bar through a first upper hinge, and wherein the second stand is coupled to the pull-up bar through a second upper hinge.

Example 15. An exercise station comprising: a base; a pull-up bar; a first stand coupled at a lower end of the first stand to a first side of the base, and coupled at an upper end of the first stand to the pull-up bar adjacent a first end of the pull-up bar; and a second stand coupled at a lower end of the second stand to a second side of the base, and coupled at an upper end of the second stand to the pull-up bar adjacent a second end of the pull-up bar; wherein the first stand comprises a first middle hinge located in a middle portion of the first stand, and wherein the second stand comprises a second middle hinge located in a middle portion of the second stand.

Example 16. The exercise station of Example 15, wherein, in an expanded state of the exercise station, the first middle hinge is unfolded and the first stand is expanded, and wherein, in a collapsed state of the exercise station, the first middle hinge is folded and the first stand is collapsed.

Example 17. The exercise station of Example 16, wherein, in the expanded state of the exercise station, the second middle hinge is unfolded and the second stand is expanded, and wherein, in the collapsed state of the exercise station, the second middle hinge is folded and the second stand is collapsed.

Example 18. The exercise station of any one of Examples 15-17, wherein the first stand is coupled to the first side of the base through a first lower hinge, and wherein the second stand is coupled to the second side of the base through a second lower hinge.

Example 19. The exercise station of any one of Examples 15-18, wherein the first stand is coupled to the pull-up bar through a first upper hinge, and wherein the second stand is coupled to the pull-up bar through a second upper hinge.

Example 20. A collapsible, freestanding exercise station comprising: a base configured to rest on a floor; a first stand comprising a first lower stand member and a first upper stand member, wherein the first lower stand member is hingedly coupled to a first side of the base at a lower end of the first lower stand member, and wherein the first upper stand member is hingedly coupled to an upper end of the first lower stand member at a lower end of the first upper stand member; a second stand comprising a second lower stand member and a second upper stand member, wherein the second lower stand member is hingedly coupled to a second side of the base at a lower end of the second lower stand member, and wherein the second upper stand member is hingedly coupled to an upper end of the second lower stand member at a lower end of the second upper stand member; and a pull-up bar hingedly coupled to an upper end of the first upper stand member at a first side of the pull-up bar, and hingedly coupled to an upper end of the second upper stand member at a second side of the pull-up bar.

Example 21. The collapsible, freestanding exercise station of Example 20, wherein, in an expanded state of the exercise station, the first lower stand member, the first upper stand member, the second lower stand member, and the second upper stand member are each oriented substantially vertically, and wherein, in a collapsed state of the exercise station, the first lower stand member, the first upper stand member, the second lower stand member, and the second upper stand member are each oriented substantially laterally.

Example 22. The collapsible, freestanding exercise station of any one of Examples 20-21, further comprising: a first lower locking mechanism configured to secure the first lower stand member in a substantially vertical orientation with respect to the base; a first middle locking mechanism configured to secure the first upper stand member in a substantially colinear orientation with respect to the first lower stand member; a first upper locking mechanism configured to secure the pull-up bar in a substantially perpendicular orientation with respect to the first upper stand member; a second lower locking mechanism configured to secure the second lower stand member in a substantially vertical orientation with respect to the base; a second middle locking mechanism configured to secure the second upper stand member in a substantially colinear orientation with respect to the second lower stand member; and a second upper locking mechanism configured to secure the pull-up bar in a substantially perpendicular orientation with respect to the second upper stand member.

Example 23. The collapsible, freestanding exercise station of Example 22, wherein each of the first lower locking mechanism, the first middle locking mechanism, the first upper locking mechanism, the second lower locking mechanism, the second middle locking mechanism, and the second upper locking mechanism are disengageable into an unlocked state.

Example 24. The collapsible, freestanding exercise station of Example 23, wherein disengagement of the first lower locking mechanism, the first middle locking mechanism, the first upper locking mechanism, the second lower locking mechanism, the second middle locking mechanism, and the second upper locking mechanism allows the exercise station to fold into a collapsed state.

Example 25. The collapsible, freestanding exercise station of any one of Examples 20-24, wherein each of the first lower stand member, the first upper stand member, the second lower stand member, and the second upper stand member are elongate structural members.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Similarly, it should be appreciated by one of skill in the art with the benefit of this disclosure that in the above description of embodiments, various features are sometimes grouped together in a single embodiment, figure, or description thereof for the purpose of streamlining the disclosure. This method of disclosure, however, is not to be interpreted as reflecting an intention that any claim requires more features than those expressly recited in that claim. Rather, as the following claims reflect, inventive aspects lie in a combination of fewer than all features of any single foregoing disclosed embodiment.

Recitation in the claims of the terms "first," "second," "third," etc., are not necessarily used herein to connote a specific order or number of elements. Generally, the terms "first," "second," "third," etc., are used to distinguish between different elements as generic identifiers. Absent a showing that the terms "first," "second," "third," etc., connote a specific order, these terms should not be understood to connote a specific order. Furthermore, absent a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

It will be apparent to those having skill in the art with the benefit of this disclosure that changes may be made to the details of the above-described embodiments without departing from the underlying principles of the present disclosure.

The examples and embodiments disclosed herein are to be construed as illustrative and exemplary and not a limitation of the scope of the present invention in any way. It will be apparent to those having skill in the art with the benefit of this disclosure that many changes may be made to the details of the above-described embodiments without departing from the underlying principles of the invention as claimed hereinafter. The scope of the present invention should, therefore, be determined only by the following claims.

What is claimed is:

1. An exercise station comprising:

a base;

a first stand;

a second stand; and a pull-up bar, wherein, in an expanded state of the exercise station, the base is configured to rest on a floor, the first stand is coupled to the base in a substantially vertical orientation, the second stand is coupled to the base in a substantially vertical orientation, and the pull-up bar is coupled to the first stand and to the second stand in a substantially lateral orientation, wherein, in a collapsed state of the exercise station, the base is configured to rest on a floor, the first stand is coupled to the base in a substantially lateral orientation, the second stand is coupled to the base in a substantially lateral orientation, and the pull-up bar is coupled to the first stand and to the second stand in a substantially lateral orientation, and wherein, in the expanded state of the exercise station, the first stand and the second stand define a vertical-lateral plane, and wherein the first stand and the second stand each remain substantially in the vertical-lateral plane during a transition from the expanded state of the exercise station to the collapsed state of the exercise station.

2. The exercise station of claim 1, further comprising a first additional handle and a second additional handle, wherein the first additional handle is coupleable to the first stand, and wherein the second additional handle is coupleable to the second stand.

3. The exercise station of claim 2, wherein the first and second additional handles are selectively removeable from and selectively insertable into the first and second stands.

4. The exercise station of claim 3, further comprising a first plurality of insertion points along the first stand and a second plurality of insertion points along the second stand, wherein the first additional handle is selectively insertable into one or more insertion points of the first plurality of insertion points, and wherein the second additional handle is selectively insertable into one or more insertion points of the second plurality of insertion points.

5. The exercise station of claim 2, wherein the first and second additional handles are offset laterally inwards respectively from the first and second stands.

6. The exercise station of claim 1, wherein the first stand remains coupled to the base and to the pull-up bar during the transition from the expanded state of the exercise station to the collapsed state of the exercise station.

7. The exercise station of claim 6, wherein the second stand remains coupled to the base and to the pull-up bar during the transition from the expanded state of the exercise station to the collapsed state of the exercise station.

8. The exercise station of claim 1, wherein, in the collapsed state of the exercise station, the first stand is folded and the second stand is folded.

9. The exercise station of claim 1, wherein the collapsed state of the exercise station has a vertical profile with a height of less than 20% of a height of a vertical profile of the expanded state of the exercise station.

10. The exercise station of claim 1, wherein the first stand is coupled to the base through a first lower hinge and first lower lock mechanism, and wherein the second stand is coupled to the base through a second lower hinge and second lower lock mechanism.

11. The exercise station of claim 1, wherein the first stand comprises a first middle hinge located in a middle portion of the first stand and the second stand comprises a second middle hinge located in a middle portion of the second stand.

12. The exercise station of claim 1, wherein the first stand is coupled to the base through a first lower hinge, and wherein the second stand is coupled to the base through a second lower hinge.

13. The exercise station of claim 1, wherein the first stand is coupled to the pull-up bar through a first upper hinge, and wherein the second stand is coupled to the pull-up bar through a second upper hinge.

14. A collapsible, freestanding exercise station comprising:

a base configured to rest on a floor;

a first stand comprising a first lower stand member and a first upper stand member, wherein the first lower stand member is hingedly coupled to a first side of the base at a lower end of the first lower stand member, and wherein the first upper stand member is hingedly coupled to an upper end of the first lower stand member at a lower end of the first upper stand member;

a second stand comprising a second lower stand member and a second upper stand member, wherein the second lower stand member is hingedly coupled to a second side of the base at a lower end of the second lower stand member, and wherein the second upper stand member is hingedly coupled to an upper end of the second lower stand member at a lower end of the second upper stand member; and a pull-up bar hingedly coupled to an upper end of the first upper stand member at a first side of the pull-up bar, and hingedly coupled to an upper end of the second upper stand member at a second side of the pull-up bar.

15. The collapsible, freestanding exercise station of claim 14, further comprising:

a first lower lock mechanism configured to secure the first lower stand member in a substantially vertical orientation with respect to the base;

a first middle lock mechanism configured to secure the first upper stand member in a substantially colinear orientation with respect to the first lower stand member;

a first upper lock mechanism configured to secure the pull-up bar in a substantially perpendicular orientation with respect to the first upper stand member;

a second lower lock mechanism configured to secure the second lower stand member in a substantially vertical orientation with respect to the base;

a second middle lock mechanism configured to secure the second upper stand member in a substantially colinear orientation with respect to the second lower stand member; and a second upper lock mechanism configured to secure the pull-up bar in a substantially perpendicular orientation with respect to the second upper stand member.

16. The collapsible, freestanding exercise station of claim 15, wherein each of the first lower lock mechanism, the first middle lock mechanism, the first upper lock mechanism, the second lower lock mechanism, the second middle lock mechanism, and the second upper lock mechanism are disengageable into an unlocked state.

17. The collapsible, freestanding exercise station of claim 16, wherein disengagement of the first lower lock mechanism, the first middle lock mechanism, the first upper lock mechanism, the second lower lock mechanism, the second middle lock mechanism, and the second upper lock mechanism allows the collapsible, freestanding exercise station to fold into a collapsed state.

18. The collapsible, freestanding exercise station of claim 14, wherein, in an expanded state of the collapsible, freestanding exercise station, the first lower stand member, the first upper stand member, the second lower stand member, and the second upper stand member are each oriented substantially vertically, and wherein, in a collapsed state of the collapsible, freestanding exercise station, the first lower stand member, the first upper stand member, the second lower stand member, and the second upper stand member are each oriented substantially laterally.

19. The collapsible, freestanding exercise station of claim 14, wherein each of the first lower stand member, the first upper stand member, the second lower stand member, and the second upper stand member are elongate structural members.

20. The collapsible, freestanding exercise station of claim 14, further comprising:

a first lower lock mechanism configured to secure the first lower stand member in a substantially vertical orientation with respect to the base;

a first middle lock mechanism configured to secure the first upper stand member in a substantially colinear orientation with respect to the first lower stand member;

a second lower lock mechanism configured to secure the second lower stand member in a substantially vertical orientation with respect to the base; and a second middle lock mechanism configured to secure the second upper stand member in a substantially colinear orientation with respect to the second lower stand member.

* * * * *